US009135875B2

(12) United States Patent
Zhang et al.

(10) Patent No.: US 9,135,875 B2
(45) Date of Patent: Sep. 15, 2015

(54) METHOD FOR CHARGING PIXEL POINTS ON TFT-LCD SUBSTRATE, DEVICE FOR THE SAME, AND SOURCE DRIVER

(71) Applicant: BOE TECHNOLOGY GROUP CO., LTD., Beijing (CN)

(72) Inventors: Yongdong Zhang, Beijing (CN); Shiming Shi, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 80 days.

(21) Appl. No.: 14/128,195

(22) PCT Filed: Dec. 17, 2012

(86) PCT No.: PCT/CN2012/086793

§ 371 (c)(1),
(2) Date: Dec. 20, 2013

(87) PCT Pub. No.: WO2013/113235

PCT Pub. Date: Aug. 8, 2013

(65) Prior Publication Data

US 2014/0139511 A1 May 22, 2014

(30) Foreign Application Priority Data

Feb. 3, 2012 (CN) ..... 2012 1 0024063

(51) Int. Cl.
*G09G 3/36* (2006.01)

(52) U.S. Cl.
CPC ..... *G09G 3/3648* (2013.01); *G09G 3/3685* (2013.01); *G09G 2310/027* (2013.01); *G09G 2330/021* (2013.01)

(58) Field of Classification Search
CPC combination set(s) only.
See application file for complete search history.

(56) References Cited

U.S. PATENT DOCUMENTS

| | | | | |
|---|---|---|---|---|
| 5,453,757 | A | 9/1995 | Date et al. | |
| 2003/0132907 | A1 * | 7/2003 | Lee et al. | 345/98 |
| 2007/0040781 | A1 * | 2/2007 | Senda et al. | 345/87 |
| 2008/0297390 | A1 * | 12/2008 | Ko et al. | 341/144 |
| 2012/0249511 | A1 * | 10/2012 | Shiu et al. | 345/211 |

FOREIGN PATENT DOCUMENTS

| | | | |
|---|---|---|---|
| CN | 1567406 | A | 1/2005 |
| CN | 1917029 | A | 2/2007 |
| CN | 102654987 | A | 9/2012 |

OTHER PUBLICATIONS

First Chinese Office Action dated May 6, 2013; Appln. No. 201210024063.1.
Second Chinese Office Action dated Dec. 5, 2013; Appln. No. 201210024063.1.

(Continued)

*Primary Examiner* — Dwayne Bost
*Assistant Examiner* — Robert Michaud
(74) *Attorney, Agent, or Firm* — Ladas & Parry LLP

(57) ABSTRACT

Disclosed are a method, a device and a source driver for charging pixel points on a TFT-LCD substrate, which are capable of charging electrodes on an upper substrate and pixel points on a lower substrate. The charging method includes: switching on a first, second, third and fourth switches, switching off a fifth, sixth and seventh switches, and charging a first, second, third and fourth capacitors; switching off the first, second, third, fourth, sixth and seventh switches, and charging a fifth capacitor; switching off the fifth switch, switching on the first, second, third, fourth, sixth and seventh switches, so that the first capacitor stores positive six-bit pixel voltage and the fourth capacitor stores negative six-bit pixel voltage; and charging the pixel points on the lower substrate by the first and fourth capacitors, and charging the electrodes on the upper substrate by the fifth capacitor.

9 Claims, 2 Drawing Sheets

(56) References Cited

OTHER PUBLICATIONS

Third Chinese Office Action dated Apr. 17, 2014; Appln. No. 201210024063.1.

international Preliminary Repot on Patentability dated Aug. 5, 2014; PCT/CN2012/086793.

International Search Report mailed Mar. 21, 2013; PCT/CN2012/086793.

* cited by examiner

METHOD FOR CHARGING PIXEL POINTS ON TFT-LCD SUBSTRATE, DEVICE FOR THE SAME, AND SOURCE DRIVER

TECHNICAL FIELD

The present disclosure relates to the art of a liquid crystal display, particularly to a method and a device for charging pixel points on a TFT-LCD substrate and a source driver.

BACKGROUND

A Thin Film Transistor-Liquid Crystal Display (TFT-LCD), which is a typical representative of active matrix liquid crystal displays, is developed rapidly especially in the applications such as mobile phones, notebook computers and video cameras, etc. Research on low power consumption of the TFT-LCD in the mobile phone application is very important. The research shows that conventional source drivers are not designed to achieve low power consumption when charging pixel points on a TFT-LCD substrate, and thus the power consumption can not be reduced.

SUMMARY

Embodiments of the present disclosure provide a method and a device for charging pixel points on a TFT-LCD substrate and a source driver, which may charge electrodes on an upper substrate and pixel points on a lower substrate and may further reduce the power consumption of the source driver.

To achieve the above objects, the embodiments of the present disclosure employ the following technical solutions.

According to one aspect, an embodiment of the present disclosure provides a method for charging pixel points on a TFT-LCD substrate, and the method comprises: converting, by a digital to analog converter (DAC), an input digital signal into a positive high three-bit pixel voltage, a positive low three-bit pixel voltage, a negative high three-bit pixel voltage, and a negative low three-bit pixel voltage for output. The method further comprises:

Controlling a first switch, a second switch, a third switch and a fourth switch to be switched on and a fifth switch, a sixth switch and a seventh switch to be switched off to respectively charge a first capacitor, a second capacitor, a third capacitor and a fourth capacitor, which are connected to output terminals of the DAC;

Controlling the first to fourth, the sixth and the seventh switches to be switched off and the fifth switch to be switched on so as to charge a fifth capacitor which is connected to the output terminal of the DAC;

Controlling the fifth switch to be switched off and the first to fourth and the sixth switches to be switched on so as to connect the first capacitor to the second capacitor;

Controlling the fifth switch to be switched off and the first to fourth and the seventh switches to be switched on so as to connect the third capacitor to the fourth capacitor;

Controlling a buffer disposed between output terminals of the first, the fourth and the fifth capacitors and the substrate to be turned on so that pixel points on a lower substrate are charged by the first and the fourth capacitors and electrodes on an upper substrate are charged by the fifth capacitor.

According to anther aspect, an embodiment of the present disclosure provides a device for charging pixel points on a TFT-LCD substrate, and the device comprises a control unit, a switch network unit and a power storage unit, wherein:

The switch network unit comprises a first switch, a second switch, a third switch, a fourth switch, a fifth switch, a sixth switch and a seventh switch;

The power storage unit comprises a first capacitor, a second capacitor, a third capacitor, a fourth capacitor and a fifth capacitor;

The control unit is configured to:

Control the first to fourth switches to be switched on and the fifth to seventh switches to be switched off to respectively charge the first to fourth capacitors, which are connected to output terminals of a DAC;

Control the first to fourth, the sixth and the seventh switches to be switched off and the fifth switch to be switched on so as to charge the fifth capacitor which is connected to the output terminal of the DAC;

Control the fifth switch to be switched off and the first to fourth and the sixth switches to be switched on so as to connect the first capacitor to the second capacitor;

Control the fifth switch to be switched off and the first to fourth and the seventh switches to be switched on so as to connect the third capacitor to the fourth capacitor;

Control a buffer disposed between output terminals of the first, the fourth and the fifth capacitors and the substrate to be turned on so that pixel points on a lower substrate are charged by the first and the fourth capacitors and electrodes on an upper substrate are charged by the fifth capacitor.

According to another aspect, an embodiment of the present disclosure provides a source driver which comprises a digital to analog converter (DAC) and a buffer, wherein the DAC is configured to convert an input digital signal into a positive high three-bit pixel voltage, a positive low three-bit pixel voltage, a negative high three-bit pixel voltage and a negative low three-bit pixel voltage for output, and the buffer is configured to output the voltages. The source driver also comprises a plurality of devices for charging pixel points on a TFT-LCD substrate each comprising a control unit, a switch network unit and a power storage unit, wherein:

The switch network unit comprises a first switch, a second switch, a third switch, a fourth switch, a fifth switch, a sixth switch and a seventh switch;

The power storage unit comprises a first capacitor, a second capacitor, a third capacitor, a fourth capacitor and a fifth capacitor;

The control unit is configured to:

Control the first to fourth switches to be switched on and the fifth to seventh switches to be switched off to respectively charge the first to fourth capacitors which are connected to output terminals of the DAC;

Control the first to fourth, the sixth and the seventh switches to be switched off and the fifth switch to be switched on so as to charge the fifth capacitor which is connected to the output terminal of the DAC;

Control the fifth switch to be switched off and the first to fourth and the sixth switches to be switched on so as to connect the first capacitor to the second capacitor;

Control the fifth switch to be switched off and the first to fourth and the seventh switches to be switched on so as to connect the third capacitor to the fourth capacitor;

Control the buffer disposed between output terminals of the first, the fourth and the fifth capacitors and the substrate to be turned on so that pixel points on a lower substrate are charged by the first and the fourth capacitors and electrodes on an upper substrate are charged by the fifth capacitor.

The method and the device for charging pixel points on a TFT-LCD substrate and the source driver provided by the embodiments of the present disclosure control the respective switches of the switch network to be switched on or switched off via the control unit, thereby firstly store the positive high three-bit pixel voltage, the positive low three-bit pixel voltage, the negative high three-bit pixel voltage and the negative low three-bit pixel voltage output from the DAC into respective capacitors of the power storage unit, respectively, and then transfer the pixel voltage stored in the second capacitor to the first capacitor, transfer the pixel voltage stored in the third capacitor into the fourth capacitor, and finally turn on the buffer connected to the respective capacitors so that the pixel points on a lower substrate are charged by the first and fourth capacitors and the electrodes on the upper substrate are charged by the fifth capacitor. With the technical solution, the electrodes on the upper substrate and the pixel points on a lower substrate can be charged, and the power consumption of the source driver can be reduced effectively.

BRIEF DESCRIPTION OF THE DRAWINGS

In order to describe the embodiments of the present disclosure or solutions of the related art more clearly, the accompanying drawings which are useful for describing the embodiments or the related art will be described briefly below. It is obvious that the drawings described below merely illustrate some embodiments of the present disclosure, and those skilled in the related art may obtain further drawings on the basis of these drawings without paying inventive efforts.

DETAILED DESCRIPTION

The technical solutions in the embodiments of the present disclosure will be described more fully and more clearly hereinafter in connection with the embodiments of the present disclosure illustrated in the accompanying drawings. It is obvious that the described embodiments are not all of but merely a portion of the embodiments of the invention. All further embodiments that those skilled in the related art can derive from the embodiments of the present disclosure without paying inventive efforts belong to the protection scope of the invention.

Figure 1:
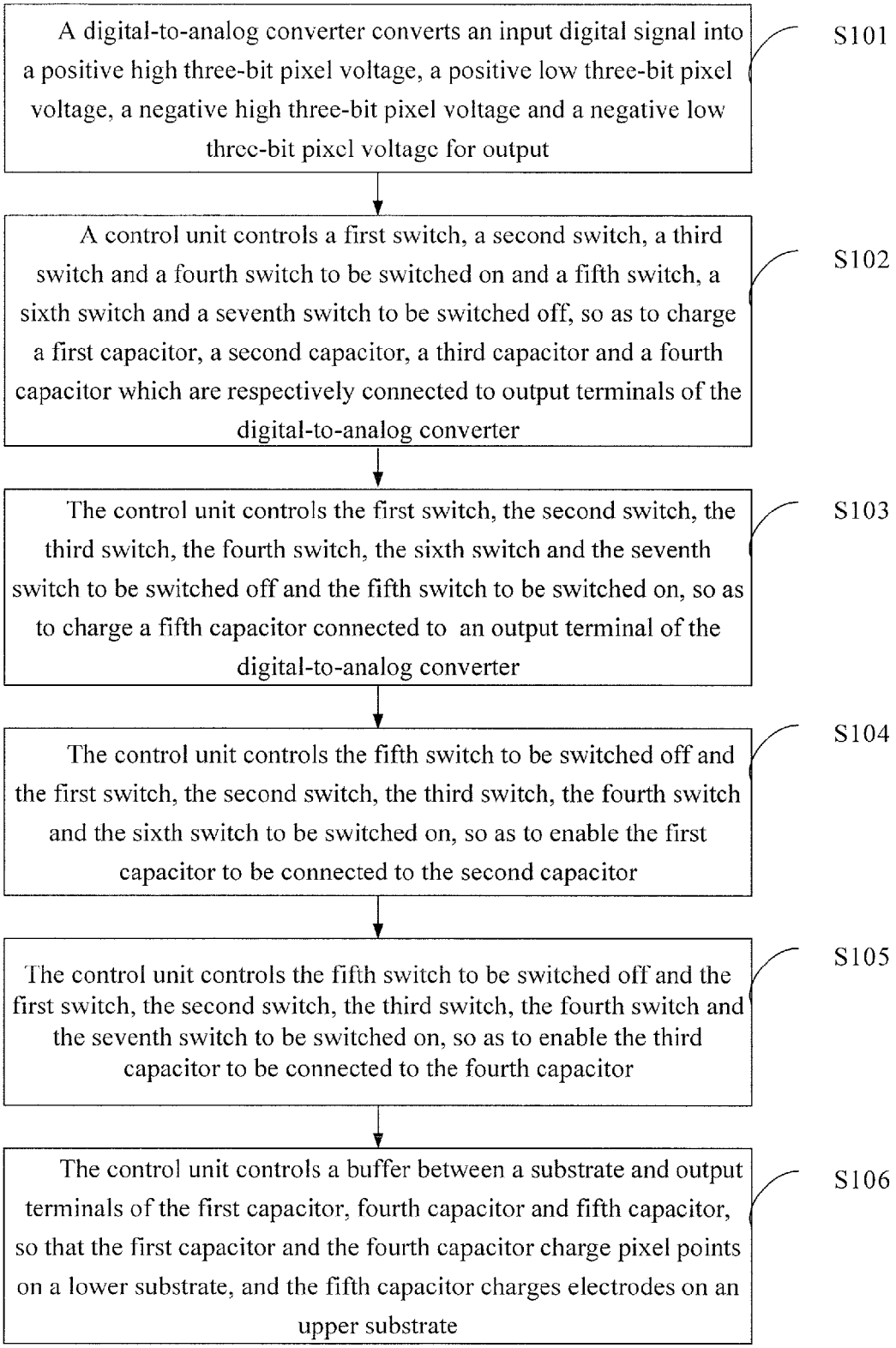
FIG. 1 is a schematic diagram illustrating a flow of a method for charging pixel points on a TFT-LCD substrate according to an embodiment of the present disclosure.

As illustrated in FIG. 1, the method for charging pixel points on a TFT-LCD substrate provided by an embodiment of the present disclosure comprises the following steps.

At step S101, a digital to analog converter (DAC) converts an input digital signal into a positive high three-bit pixel voltage, a positive low three-bit pixel voltage, a negative high three-bit pixel voltage and a negative low three-bit pixel voltage for output.

The DAC, which is also referred to as a D/A converter, can convert parallel binary digital data into a Direct Current (DC) voltage or a DC current. In the present embodiment, the DAC converts the input digital signal into the positive high three-bit pixel voltage, the positive low three-bit pixel voltage, the negative high three-bit pixel voltage and the negative low three-bit pixel voltage for output.

At step S102, a control unit controls a first switch, a second switch, a third switch and a fourth switch to be switched on and a fifth switch, a sixth switch, a seventh switch to be switched off to respectively charge a first capacitor, a second capacitor, a third capacitor, and a fourth capacitor which are connected to output terminals of the DAC.

This phase is a charging phase, during which the first to fourth switches are switched on and the fifth to seventh switches are switched off under control of the control unit to respectively charge the first to fourth capacitors which are connected to the output terminals of the DAC, so that the first capacitor stores the positive high three-bit pixel voltage from the DAC, the second capacitor stores the positive low three-bit pixel voltage from the DAC, the third capacitor stores the negative low three-bit pixel voltage from the DAC, and the fourth capacitor stores the negative high three-bit pixel voltage from the DAC.

Here, the first to seventh switches can be metal oxide semiconductor transistors.

At step S103, the control unit controls the first to fourth, the sixth and the seventh switch to be switched off and the fifth switch to be switched on so as to charge a fifth capacitor which is connected to the output terminal of the DAC.

This phase is a reference voltage charging phase, during which the first to fourth, the sixth and the seventh switches are switched off and the fifth switch is switched on under the control of the control unit, so that the fifth capacitor stores the positive high three-bit pixel voltage, the positive low three-bit pixel voltage, the negative high three-bit pixel voltage as well as the negative low three-bit pixel voltage from the DAC.

At step S104, the control unit controls the fifth switch to be switched off and the first to fourth switches as well as the sixth switch to be switched on so that the first capacitor is connected to the second capacitor.

This phase is a power reuse phase, during which the fifth switch is switched off and the first to fourth and the sixth switches are switched on under the control of the control unit, thus a voltage difference is generated between the first and the second capacitors, and since the first capacitor stores the positive high three-bit pixel voltage and the second capacitor stores the positive low three-bit pixel voltage, the first capacitor may store a positive six-bit pixel voltage after the power reuse phase.

At step S105, the control unit controls the fifth switch to be switched off and the first to fourth and the seventh switches to be switched on so that the third capacitor is connected to the fourth capacitor.

This phase is also a power reuse phase, during which the fifth switch is switched off and the first to fourth and the seventh switches are switched on under the control of the control unit, thus a voltage difference is generated between the third and the fourth capacitors, and since the third capacitor stores the negative low three-bit pixel voltage and the fourth capacitor stores the negative high three-hit pixel voltage, the fourth capacitor may store a negative six-bit pixel voltage after the power reuse phase.

It should be noted that one terminal of the sixth switch is connected to an input terminal of the first switch, the other terminal of the sixth switch is connected to an output terminal of the second switch, and the sixth switch is connected in parallel to the first and the second switches; and that one terminal of the seventh switch is connected to an output terminal of the third switch, the other terminal of the seventh switch is connected to an input terminal of the fourth switch, and the seventh switch is connected in parallel to the third and the fourth switches.

At step S106, the control unit controls a buffer disposed between output terminals of the first, the fourth and the fifth capacitors and the substrate to be turned on so that pixel points on a lower substrate are charged by the first and the fourth capacitors and electrodes on an upper substrate are charged by the fifth capacitor.

This phase is a discharging phase, during which the pixel points on the lower substrate are charged by the first and the fourth capacitors and the electrodes on the upper substrate are charged by the fifth capacitor, after the buffer is enabled by the control unit.

It shall be noted that it is merely for the purpose of illustration that the positive high three-bit pixel voltage is stored in the first capacitor, the positive low three-bit pixel voltage is stored in the second capacitor, the negative low three-bit pixel voltage is stored in the third capacitor, the negative high three-bit pixel voltage is stored in the fourth capacitor, the pixel points on the lower substrate are charged with the first and the fourth capacitors and the electrodes on the upper substrate are charged with the fifth capacitor, and the present disclosure does not limit the charging method in terms of which capacitors for use of storing the respective pixel voltages and which capacitors for use of charging the substrate. On the contrary, the other charging methods that are under the same principle as the disclosed method shall be within the protection scope of the invention.

In addition, the first switch is connected in series to the first capacitor, the second switch is connected in series to the second capacitor, the third switch is connected in series to the third capacitor, the fourth switch is connected in series to the fourth capacitor, and the fifth switch is connected in series to the fifth capacitor.

The method for charging pixel points on a TFT-LCD substrate provided by the embodiment of the present disclosure controls the respective switches of a switch network to be switched on or switched off via the control unit, thereby firstly stores the positive high three-bit pixel voltage, the positive low three-bit pixel voltage, the negative high three-bit pixel voltage and the negative low three-bit pixel voltage output from the DAC into respective capacitors of the power storage unit, respectively, and then transfers the pixel voltage stored in the second capacitor to the first capacitor, transfers the pixel voltage stored in the third capacitor into the fourth capacitor, and finally turns on the buffer connected to the respective capacitors so that the pixel points on the lower substrate are charged by the first and fourth capacitors and the electrodes on the upper substrate are charged by the fifth capacitor. With this technical solution, the electrodes on the upper substrate and the pixel points on the lower substrate can be charged, and the power consumption of the source driver can be reduced effectively.

Figure 2:
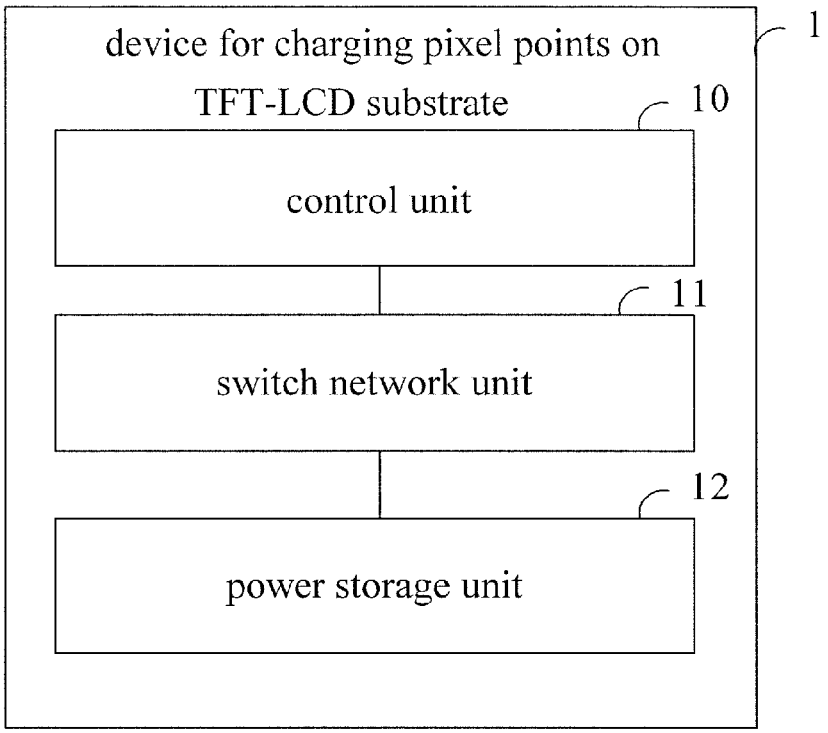
FIG. 2 is a schematic diagram illustrating a structure of a device for charging pixel points on a TFT-LCD substrate according to an embodiment of the present disclosure.
Figure 3:
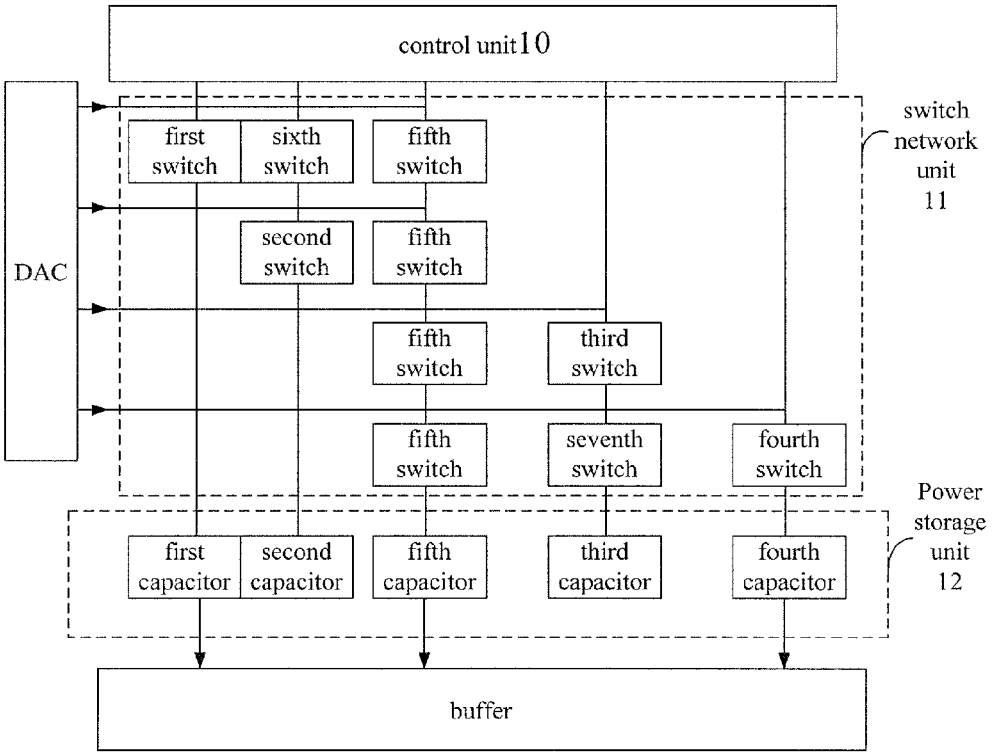
FIG. 3 is another schematic diagram illustrating a device for charging pixel points on a TFT-LCD substrate according to an embodiment of the present disclosure.

An embodiment of the present disclosure provides a device 1 for charging pixel points on a TFT-LCD substrate, which will be exemplarily described by referring to FIG. 2 in combination with FIG. 3. The device 1 for charging pixel points on a TFT-LCD substrate comprises a control unit 10, a switch network unit 11 and a power storage unit 12.

The switch network unit 11 comprises a first switch, a second switch, a third switch, a fourth switch, a fifth switch, a sixth switch and a seventh switch.

The power storage unit 12 comprises a first capacitor, a second capacitor, a third capacitor, a fourth capacitor and a fifth capacitor.

The control unit 10 is configured to:

Control the first to fourth switches to be switched on and the fifth to seventh switches to be switched off to respectively charge the first to fourth capacitors which are connected to output terminals of the DAC, so that the first capacitor stores the positive high three-bit pixel voltage from the DAC, the second capacitor stores the positive low three-bit pixel voltage from the DAC, the third capacitor stores the negative low three-bit pixel voltage from the DAC and the fourth capacitor stores the negative high three-bit pixel voltage from the DAC:

Control the first to fourth, the sixth and the seventh switches to be switched off and the fifth switch to be switched on so as to charge the fifth capacitor which is connected to the DAC, so that the fifth capacitor stores the positive high three-bit pixel voltage, the positive low three-bit pixel voltage, the negative high three-bit pixel voltage as well as the negative low three-bit pixel voltage from the DAC;

Control the fifth switch to be switched off and the first to fourth and the sixth switches to switched on so as to connect the first capacitor to the second capacitor, so that the first capacitor stores the positive six-bit pixel voltage;

Control the fifth switch to be switched off and the first to fourth and the seventh switches to be switched off so as to connect the third capacitor to the fourth capacitor, so that the fourth capacitor stores the negative six-bit pixel voltage;

Control a buffer disposed between output terminals of the first, the fourth and the fifth capacitors and the substrate to be turned on so that pixel points on a lower substrate are charged by the first and the fourth capacitors and electrodes on an upper substrate are charged by the fifth capacitor.

In addition, the first switch is connected in series to the first capacitor, the second switch is connected in series to the second capacitor, the third switch is connected in series to the third capacitor, the fourth switch is connected in series to the fourth capacitor, and the fifth switch is connected in series to the fifth capacitor.

Moreover, one terminal of the sixth switch is connected to an input terminal of the first switch, the other terminal of the sixth switch is connected to an output terminal of the second switch, and the sixth switch is connected in parallel to the first and the second switches; and one terminal of the seventh switch is connected to an output terminal of the third switch, the other terminal of the seventh switch is connected to an input terminal of the fourth switch, and the seventh switch is connected in parallel to the third and the fourth switches.

The device for charging pixel points on a TFT-LCD substrate provided by the embodiment of the present disclosure controls the respective switches of the switch network to be switched on or switched off via the control unit, thereby firstly stores the positive high three-bit pixel voltage, the positive low three-bit pixel voltage, the negative high three-bit pixel voltage and the negative low three-bit pixel voltage output from the DAC into a respective capacitors of the power storage unit, respectively, and then transfers the pixel voltage stored in the second capacitor to the first capacitor, transfers the pixel voltage stored in the third capacitor into the fourth capacitor, and finally turns on the buffer connected to the respective capacitors so that pixel points on the lower substrate are charged by the first and fourth capacitors and electrodes on the upper substrate are charged by the fifth capacitor. With this technical solution, the electrodes on the upper substrate and pixel points on the lower substrate can be charged, and the power consumption of the source driver can be reduced effectively.

According to an embodiment of the present disclosure, a source driver is provided. The source driver includes a digital to analog converter (DAC) and a buffer. The DAC is configured to convert an input digital signal into a positive high three-bit pixel voltage, a positive low three-bit pixel voltage, a negative high three-bit pixel voltage and a negative low three-bit pixel voltage for output. The buffer is configured to output the voltages. The source driver may further include a plurality of devices for charging pixel points on the TFT-LCD substrate which have the same functions. The device for charging the pixel points on the TFT-LCD substrate includes a control unit, a switch network unit and a power storage unit, wherein:

The switch network unit comprises a first switch, a second switch, a third switch, a fourth switch, a fifth switch, a sixth switch and a seventh switch;

The power storage unit comprises a first capacitor, a second capacitor, a third capacitor, a fourth capacitor and a fifth capacitor;

The control unit is configured to:

Control the first to fourth switches to be switched on and the fifth to seventh switches to be switched off to respectively charge the first to fourth capacitors which are connected to output terminals of the DAC;

Control the first to fourth, the sixth and the seventh switches to be switched off and the fifth switch to be switched on so as to charge the fifth capacitor which is connected to the output terminal of the DAC;

Control the fifth switch to be switched off and the first to fourth and the sixth switches to be switched on so as to connect the first capacitor to the second capacitor;

Control the fifth switch to be switched off and the first to fourth and the seventh switches to be switched on so as to connect the third capacitor to the fourth capacitor:

Control the buffer disposed between output terminals of the first, the fourth and the fifth capacitors and the substrate to be turned on so that pixel points on a lower substrate are charged by the first and the fourth capacitors and electrodes on an upper substrate are charged by the fifth capacitor.

The structure of the liquid display panel of the above-described device for charging the pixel points on the TFT-LCD substrate is the same as that of the above-described embodiments, thus repeated descriptions are omitted.

Those skilled in the related art can understand that all or part of the steps for achieving the above method embodiment can be implemented by hardware in association with program instructions. The program can be stored in a computer readable storage medium, and can, when being executed, perform the steps in the above method embodiment. The storage medium may include various medium for storing program codes, such as a ROM, a RAM, a magnetic disc or an optical disc, etc.

Described above are merely detailed embodiments of the present disclosure, and the protection scope of the invention is not limited thereto. All the changes and alternatives that can be contemplated by those skilled in the related art within the technical scope disclosed by the embodiments of the present disclosure should be covered by the protection scope of the invention. Therefore the protection scope of the invention is defined by the protection scope of the claims.

What is claimed is:

1. A method for charging pixel points on a TFT-LCD substrate, comprising:

converting, by a digital to analog converter (DAC), an input digital signal into a positive high three-bit pixel voltage, a positive low three-bit pixel voltage, a negative high three-bit pixel voltage, and a negative low three-bit pixel voltage for output, wherein the method further comprises:

controlling a first switch, a second switch, a third switch and a fourth switch to be switched on and a fifth switch, a sixth switch and a seventh switch to be switched off to respectively charging a first capacitor, a second capacitor, a third capacitor and a fourth capacitor which are connected to output terminals of the DAC, "so that the first capacitor stores the positive high three-bit pixel voltage output from the DAC, the second capacitor stores the positive low three-bit pixel voltage output from the DAC, the third capacitor stores the negative low three-bit pixel voltage output from the DAC and the fourth capacitor stores the negative high three-bit pixel voltage output from the DAC";

controlling the first to fourth, the sixth and the seventh switches to be switched off and the fifth switch to be switched on so as to charge a fifth capacitor which is connected to the output terminal of the DAC;

controlling the fifth switch to be switched off and the first to fourth and the sixth switches to be switched on so as to connect the first capacitor to the second capacitor;

controlling the fifth switch to be switched off and the first to fourth and the seventh switches to be switched on so as to connect the third capacitor to the fourth capacitor;

controlling a buffer disposed between output terminals of the first, the fourth and the fifth capacitors and the substrate to be turned on so that pixel points on a lower substrate are charged by the first and the fourth capacitors and electrodes on an upper substrate are charged by the fifth capacitor.

2. The method for charging the pixel points on the TFT-LCD substrate of claim 1, wherein the fifth capacitor which is connected to the output terminal of the DAC is charged so that the fifth capacitor stores the positive high three-bit pixel voltage, the positive low three-bit pixel voltage, the negative high three-bit pixel voltage and the negative low three-bit pixel voltage output from the DAC.

3. The method for charging the pixel points on the TFT-LCD substrate of claim 1, wherein the first capacitor is connected to the second capacitor so that the first capacitor stores a positive six-bit pixel voltage.

4. The method for charging the pixel points on the TFT-LCD substrate of claim 1, wherein the third capacitor is connected to the fourth capacitor so that the fourth capacitor stores a negative six-bit pixel voltage.

5. A device for charging the pixel points on the TFT-LCD substrate, comprising a control unit, a switch network unit and a power storage unit, wherein, the switch network unit comprises a first switch, a second switch, a third switch, a fourth switch, a fifth switch, a sixth switch and a seventh switch;

the power storage unit comprises a first capacitor, a second capacitor, a third capacitor, a fourth capacitor and a fifth capacitor;

the control unit is configured to:

control the first to fourth switches to be switched on and the fifth to seventh switches to be switched off to respectively charge the first to fourth capacitors which are connected to output terminals of a digital to analog converter (DAC) so that the first capacitor stores the positive high three-bit pixel voltage output from the DAC, the second capacitor stores the positive low three-bit pixel voltage output from the DAC, the third capacitor stores the negative low three-bit pixel voltage output from the DAC and the fourth capacitor stores the negative high three-bit pixel voltage output from the DAC;

control the first to fourth, the sixth and the seventh switches to be switched off and the fifth switch to be switched on so as to charge the fifth capacitor which is connected to the output terminal of the DAC;

control the fifth switch to be switched off and the first to fourth and the sixth switches to be switched on so that the first capacitor is connected to the second capacitor;

control the fifth switch to be switched off and the first to fourth and the seventh switches to be switched on so that the third capacitor is connected to the fourth capacitor;

control a buffer disposed between output terminals of the first, the fourth and the fifth capacitors and the substrate to be turned on so that pixel points on a lower substrate are charged by the first and the fourth capacitors and electrodes on an upper substrate are charged by the fifth capacitor.

6. The device for charging the pixel points on the TFT-LCD substrate of claim 5, wherein, the first switch is connected in series to the first capacitor;

the second switch is connected in series to the second capacitor;

the third switch is connected in series to the third capacitor;

the fourth switch is connected in series to the fourth capacitor; and the fifth switch is connected in series to the fifth capacitor.

7. The device for charging the pixel points on the TFT-LCD substrate of claim 5, wherein the first to seventh switches are all metal oxide semiconductor transistors.

8. The device for charging the pixel points on the TFT-LCD substrate of claim 5, wherein, one terminal of the sixth switch is connected to an input terminal of the first switch, and the other terminal of the sixth switch is connected to an output terminal of the second switch, and the sixth switch is connected in parallel to the first and the second switches;

one terminal of the seventh switch is connected to an output terminal of the third switch, the other terminal of the seventh switch is connected to an input terminal of the fourth switch, and the seventh switch is connected in parallel to the third and the fourth switches.

9. A source driver, comprising a digital to analog converter (DAC) and a buffer, wherein the DAC is configured to convert an input digital signal into a positive high three-bit pixel voltage, a positive low three-bit pixel voltage, a negative high three-bit pixel voltage and a negative low three-bit pixel voltage for output, and the buffer is configured to output the voltages, and wherein the source driver further comprises a plurality of devices for charging pixel points on a TFT-LCD substrate, and each of the plurality of devices comprises a control unit, a switch network unit and a power storage unit, wherein, the switch network unit comprises a first switch, a second switch, a third switch, a fourth switch, a fifth switch, a sixth switch and a seventh switch;

the power storage unit comprises a first capacitor, a second capacitor, a third capacitor, a fourth capacitor and a fifth capacitor;

the control unit is configured to:

control the first to fourth switches to be switched on and the fifth to seventh switches to be switched off to respectively charge the first to fourth capacitors which are connected to output terminals of the DAC, so that the first capacitor stores the positive high three-bit pixel voltage output from the DAC, the second capacitor stores the positive low three-bit pixel voltage output from the DAC, the third capacitor stores the negative low three-bit pixel voltage output from the DAC and the fourth capacitor stores the negative high three-bit pixel voltage output from the DAC;

control the first to fourth, the sixth and the seventh switches to be switched off and the fifth switch to be switched on so as to charge the fifth capacitor which is connected to the output terminal of the DAC;

control the fifth switch to be switched off and the first to fourth and the sixth switches to be switched on so as to connect the first capacitor to the second capacitor;

control the fifth switch to be switched off and the first to fourth and the seventh switches to be switched on so as to connect the third capacitor to the fourth capacitor;

control the buffer disposed between output terminals of the first, the fourth and the fifth capacitors and the substrate to be turned on so that pixel points on a lower substrate are charged by the first and the fourth capacitors and electrodes on an upper substrate are charged by the fifth capacitor.

* * * * *